US007201132B2

(12) United States Patent
Miyake et al.

(10) Patent No.: US 7,201,132 B2
(45) Date of Patent: Apr. 10, 2007

(54) COMBUSTION ENGINE OF VERTICAL SHAFT TYPE

(75) Inventors: Hitomi Miyake, Miki (JP); Takemi Inoue, Kakogawa (JP); Ichiro Uemura, Kobe (JP); Tetsuhiro Yamakawa, Maryvill, MO (US)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/159,612

(22) Filed: Jun. 23, 2005

(65) Prior Publication Data

US 2005/0229893 A1 Oct. 20, 2005

(51) Int. Cl.
*F02B 61/04* (2006.01)
*F02B 25/06* (2006.01)

(52) U.S. Cl. ..... 123/196 W; 123/196 HC; 123/572

(58) Field of Classification Search ..... 123/195 HC, 123/196 W, 572, 574
See application file for complete search history.

(56) References Cited

U.S. PATENT DOCUMENTS 4,579,092 A * 4/1986 Kandler ..... 399/275
4,926,814 A * 5/1990 Bonde ..... 123/196 W
6,837,207 B2 * 1/2005 Bonde et al. ..... 123/195 HC

FOREIGN PATENT DOCUMENTS

JP 2505523 5/1996

* cited by examiner

*Primary Examiner*—Noah P. Kamen

(57) ABSTRACT

To provide an internal combustion engine of a vertical shaft type, in which leakage of an oil from a crankcase and an oil pan is effectively prevented, which has high mounting rigidity relative to a working machine and, also, which is capable of being easily serviced, the combustion engine includes a vertically extending crankshaft (9) having a pair of upper and lower crank webs (14A and 14B), a crankcase (1) accommodating the crankshaft (9) and including an oil pan (2), and a crankcase cover (3) mounted on an upper surface (1*a*) of the crankcase (1) to cover the crankcase (1). The upper surface (1*a*) of the crankcase (1) is positioned above the upper crank web (14A).

8 Claims, 6 Drawing Sheets

COMBUSTION ENGINE OF VERTICAL SHAFT TYPE

BACKGROUND OF THE INVENTION 1. (Field of the Invention)

The present invention relates to a combustion engine of a vertical shaft type having a vertically extending crankshaft, which engine may be employed for driving a working machine such as a lawn mower.

2. (Description of the Prior Art)

The conventional combustion engine of a vertical shaft type includes an engine body made up of a crankcase, in which a crankshaft is supported to extend vertically, and an engine cylinder block integrated together with the crankcase and accommodating a horizontally laid reciprocating piston, which is in turn drivingly connected to the crankshaft through a connecting rod. The engine body of the conventional combustion engine has a lower end face, with which a mount base serving to define both an oil pan of the engine and the mounting of a working machine such as a lawn mower is connected through a gasket. See, for example, the Japanese Utility Model Registration No. 2505523. The conventional combustion engine is mounted on an upper surface of the working machine, with an output shaft extending from a lower end of the crankshaft and connected to a driven unit of the working machine.

In the conventional vertical shaft type combustion engine, the plane of joint between the engine body and the mount base is positioned proximate to the oil pan positioned at a lower portion of the combustion engine. This structural feature poses the following problems: Specifically, in the conventional combustion engine, the surface level of an oil contained within the oil pan lies proximate to the plane of joint between the engine body and the mount base. Accordingly, sealing is required to avoid an undesirable leakage of the oil within the oil pan to the outside through the plane of joint, which would otherwise occur under the influence of vibrations of the combustion engine during the operation and when vibrations occurring in the working machine then connected with the combustion engine are transmitted to the engine body through the mount base.

Also, in the conventional combustion engine, since the extra mount base intervenes between the engine body and the working machine, securing of sufficient mounting rigidity for mounting the combustion engine firmly on the working machine has to be considered.

As an additional problem inherent in the conventional combustion engine, the thermal conduction from the oil pan to the cylinder block and the crankcase tends to be hampered by the presence of the gasket at the plane of joint and, therefore, the effect of cooling the oil pan through the cylinder block and the crankcase, both of which are air cooled, is so low that the temperature of the oil may not be lowered as desired. Also, during the servicing of the combustion engine, the working machine is required to be separated from the combustion engine, followed by removal of the mount base from the engine body, and, accordingly, it is indeed troublesome and time-consuming to accomplish the servicing of the combustion engine.

Furthermore, since the conventional combustion engine is so designed that a cam gear is meshed with a crank gear positioned proximate to the surface level of the oil within the oil pan and is in turn meshed with a governor gear of a governor mechanism, a governor shaft carrying the governor gear is rotatably received in a mounting hole defined in a portion of a side wall of the cylinder block adjacent the surface level of the oil within the oil pan. Because of this structural feature, sealing is required to avoid leakage of the oil to the outside through the mounting hole proximate to the oil surface level during the operation of the combustion engine.

Also, since a part of the governor gear is positioned to be immersed in the oil within the oil pan, the oil is stirred up, resulting in increase of the oil temperature. Yet, since in the conventional combustion engine a gas-oil separating chamber of a breather passage, through which blow-by gases flows from a combustion chamber of the combustion engine, is arranged at a location adjacent a portion of a cylinder head distant from an intermediate portion of the engine cylinder block, that is, at a location laterally of the entire engine structure, the separated oil remaining within the gas-oil separating chamber may leak into an intake passage through the breather passage when the combustion engine is tilted with the cylinder head oriented downwards.

SUMMARY OF THE INVENTION

In view of the foregoing, the present invention has been devised to substantially eliminate the foregoing problems and inconveniences inherent in the conventional combustion engine and is intended to provide an improved combustion engine of a vertical shaft type, in which leakage of an oil from a crankcase and an oil pan is effectively prevented, which has high mounting rigidity relative to a working machine and, also, which is capable of being easily serviced.

In order to accomplish the foregoing objects of the present invention, there is provided a combustion engine of a vertical shaft type, which engine includes a vertically extending crankshaft having a pair of upper and lower crank webs, a crankcase accommodating the crankshaft and having an oil pan, and a crankcase cover mounted on an upper surface of the crankcase to cover the crankcase. The upper surface of the crankcase is positioned above the upper crank web.

According to the vertical shaft type combustion engine of the present invention, since the crankcase cover is mounted on the upper surface of the crankcase that is positioned above the upper crank web, the plane of joint between the upper surface of the crankcase and the crankcase cover comes to a position that is spaced a relatively considerable distance upwardly from the surface level of the oil within the oil pan. Accordingly, the combustion engine of the present invention well prevents leakage of the oil from the plane of joint under the influence of the motion of the combustion engine itself during the operation thereof and/or vibrations induced by the working machine connected drivingly therewith.

Also, since the oil pan is formed integrally with the crankcase, the crankcase can be connected directly to the working machine, increasing mounting rigidity of mounting the combustion engine on the working machine. Also, since the oil within the oil pan can be effectively cooled by the thermal conduction through the air-cooled crankcase to decrease the oil temperature, functions of lubricating and cooling by the oil are enhanced. In addition, when the combustion engine is serviced, a mere removal of the crankcase cover from the crankcase is sufficient to allow the interior of the crankcase to be inspected and serviced from above. Accordingly, the servicing of the combustion engine can be performed easily.

In a preferred embodiment of the present invention, the vertical shaft type combustion engine may be a four cycle combustion engine and may further include a camshaft extending parallel to the crankshaft and having a cam gear, and a crank gear mounted on the crankshaft at a location above the upper crank web, the cam gear being meshed with the crank gear. According to this structural feature, the crank gear and the cam gear are positioned above the upper crank web, that is, positioned proximate to a cooling fan. Accordingly, the cam gear can advantageously be restrained from being thermally expanded by the cooling effect brought about by the cooling fan during the operation of the combustion engine and, hence, the gap between the cam gear and the crank gear can be kept stable. As a result thereof, noises due to increase of the backlash of the cam gear can advantageously be reduced.

Considering that in the present invention the crankcase cover is mounted on the upper surface of the crankcase, engagement of the cam gear on the camshaft with the crank gear on the crankshaft can easily be accomplished by inserting the camshaft into the crankcase through the top opening of the crankcase in a vertically downward direction until the cam gear comes to be meshed with the crank gear. In addition, since the position of the longitudinal axis of a cylinder bore of a cylinder block of the combustion engine and the position in which a connecting rod undergoes the motion are held lower by a quantity equal to the thickness of the crank gear than those in the conventional engine in which the crank gear is positioned below the lower crank web, when the combustion engine is mounted on the working machine positioned below the combustion engine, vibration of the combustion engine can advantageously be reduced to further reduce the generation of noises. Yet, positioning of the cam gear at a location that is relatively spaced a distance above the oil pan is effective to eliminate the possibility of the oil being stirred up and, therefore, the temperature of the oil can be effectively kept low.

In another preferred embodiment of the present invention, the combustion engine of the present invention further includes a governor mechanism for controlling the number of revolutions of the combustion engine. This governor mechanism includes a governor gear meshed with the cam gear for driving the governor mechanism.

Since the governor gear is meshed with the cam gear positioned above the upper crank web and since a governor shaft of the governor mechanism is rotatably received in a mounting hole defined at a location distant above from the oil pan, leakage of the oil in the oil pan to the outside through the mounting hole can be prevented. The mounting hole is preferably defined in the crankcase cover.

In a further preferred embodiment of the present invention, the combustion engine may further include a breather passage for communicating a crank chamber in the crankcase with an intake passage. In this case, a gas-oil separating chamber that forms a part of the breather passage may be in the crankcase cover.

According to this structural feature, since the gas-oil separating chamber is formed in the crankcase cover, the space for installing the gas-oil separating chamber is no longer limited as compared with that defined inside the crankcase and, therefore, the gas-oil separating chamber can easily have a desired structure having a sufficient capacity. For example, the gas-oil separating chamber may be so structured as to have a first chamber on the side of a lower surface of the crankcase cover and a second chamber on the side of an upper surface of the crankcase cover. This structural feature permits the gas-oil separating chamber to enhance the separation of blow-by gases within the breather passage into an oil and gases.

Also, the formation of the gas-oil separating chamber in the crankcase cover allows the gas-oil separating chamber to be arranged at a location intermediate of the combustion engine in its entirety and, therefore, the oil separated from the blow-by gases within the gas-oil separating chamber will hardly leak when the combustion engine is tilted.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
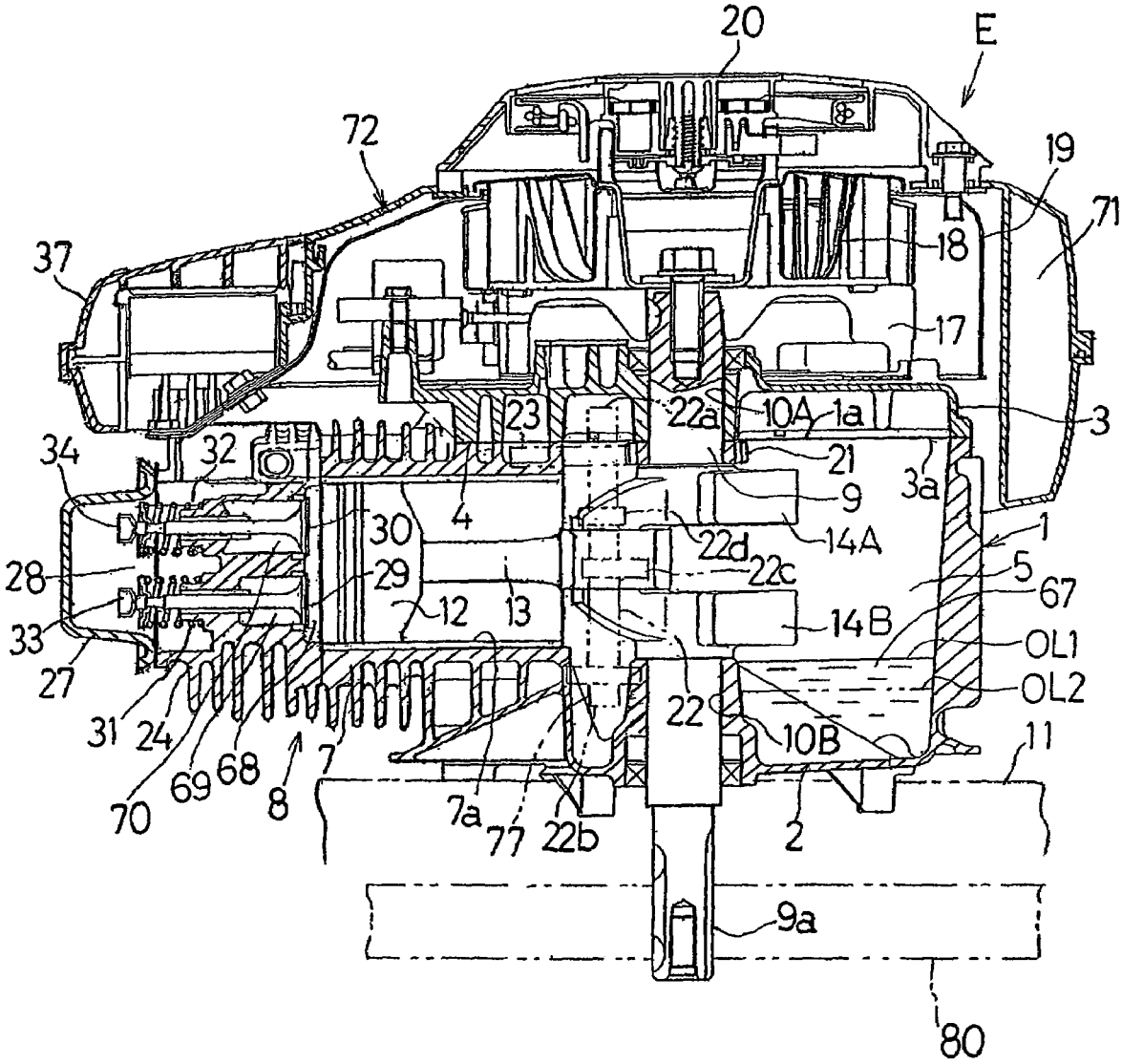
FIG. 1 is a longitudinal sectional view of a vertical shaft type internal combustion engine according to a preferred embodiment of the present invention.

Reference will now be made to the accompanying drawings for the details of a preferred embodiment of the present invention. FIG. 1 illustrates, in a longitudinal sectional representation, a four-cycle vertical shaft type internal combustion engine E embodying the present invention. This combustion engine E includes an engine body 8 made up of a crankcase 1 and a cylinder block 7. The crankcase 1 includes an oil pan 2 formed integrally therewith, and a crankcase cover 3 is held in abutment with and fixed to an upper face 1*a* of the crankcase 1, with a gasket 4 intervening between it and the upper surface 1*a* of the crankcase 1. The cylinder block 7 is formed integrally with the crankcase 1 so as to protrude laterally forwards (or leftwards as viewed in FIG. 1) of the crankcase 1.

The crankcase cover 3 is mounted on an upper surface of the engine body 8 so as to cover a top opening of the crankcase 1 and a portion of the cylinder block 7. A crankshaft 9 is accommodated within a crank chamber 5 of the crankcase 1 so as to extend vertically within the crank chamber 5 and is rotatably supported by upper and lower bearing portions 10A and 10B that are formed in the crankcase cover 3 and the crankcase 1, respectively. A lower end portion of the crankshaft 9 extends outwardly of the engine body 8 from the bottom portion of the crankcase 1 to define an output shaft 9*a* that may be drivingly connected with a working machine 11 such as a lawn mower for driving the latter.

The engine cylinder block 7 has a cylinder bore 7*a* that is defined to accommodate a piston 12 reciprocating therein in a direction axially of the cylinder block 7 (or in a direction leftwards and rightwards as viewed in FIG. 1). This reciprocating piston 12 is drivingly coupled with the crankshaft 9 through a connecting rod 13 and, accordingly, the reciprocating motion of the piston 12 can be translated into a rotary motion of the crankshaft 9 through the connecting rod 13. The rotary motion is then utilized as a driving force necessary to drive the working machine 11 through the output shaft 9*a*. The crankshaft 9 has a pair of upper and lower crank webs 14A and 14B spaced apart from each other in a direction axially of the crankshaft 9. The crank webs 14A and 14B are positioned within the crank chamber 5 of the crankcase 1. Accordingly, the plane of joint defined by the upper surface 1*a* of the crankcase 1 and a lower surface 3*a* of the crankcase cover 3 is positioned above the upper crank web 14A and, also, above the cylinder bore 7*a*.

An upper end portion of the crankshaft 9 opposite to the output shaft 9*a* and protruding outside the crankcase cover 3 has a flywheel 17 and a cooling fan 18 mounted thereon for rotation together therewith. The flywheel 17 and the cooling fan 18 are both covered by a fan housing 19, which is secured to an engine cover 72 having a fuel tank 71 and an air cleaner 37 both built therein. A recoil starter 20 is fixedly mounted atop the engine cover 72. On the other hand, a crank gear 21 is fixedly mounted on the crankshaft 9 above and in the vicinity of the upper crank web 14A.

Figure 2:
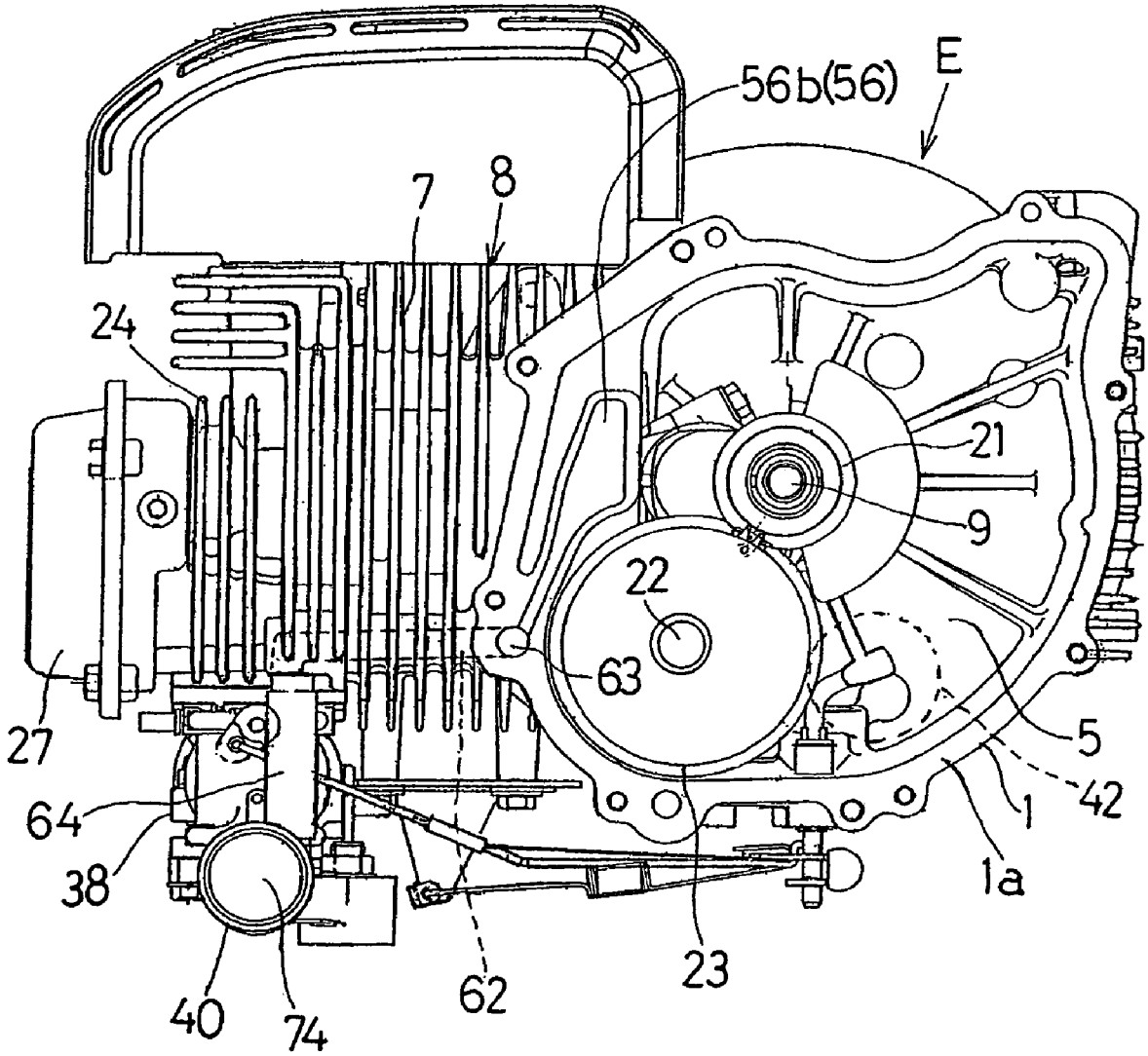
FIG. 2 is a top plan view showing the vertical shaft type internal combustion engine with crankcase and engine covers removed.

FIG. 2 illustrates a top plan view of the combustion engine E with the crankcase cover 3 and the engine cover 72 removed. Referring to FIG. 2, a camshaft 22 is arranged parallel to the crankshaft 9 within the crank chamber 5 of the crankcase 1. As shown in FIG. 1, the camshaft 22 has its opposite ends 22*a* and 22*b* rotatably supported by the crankcase cover 3 and the crankcase 1, respectively. This camshaft 22 has a cam gear 23 fixedly mounted on an upper end portion thereof as shown in FIG. 2, which is meshed with the crank gear 21 so that the rotary motion of the crankshaft 9 can be transmitted to the camshaft 22 through the meshed engagement between the crank gear 21 and the cam gear 23.

On the other hand, as shown in FIG. 1, a cylinder head 24 is fixed to a free end portion of the cylinder block 7, and a rocker cover 27 is fixed to a free end portion of the cylinder head 24. This rocker cover 27 cooperates with the cylinder head 24 to define a valve chamber 28 therebetween. The cylinder head 24 supports an intake valve 29 and an exhaust valve 30, which are biased by respective springs 31 and 32 so as to close intake and exhaust ports 69 and 70 and are driven to open the ports 69 and 70 by the rocking motions of respective rocker arms 33 and 34 accommodated within the valve chamber 28. The rocker arms 33 and 34 are driven through associated tappets and pushrods (both not shown) that are driven by cams 22*c* and 22*d* formed on the camshaft 22, as the camshaft 22 is rotated in unison with the crankshaft 9.

Figure 3:
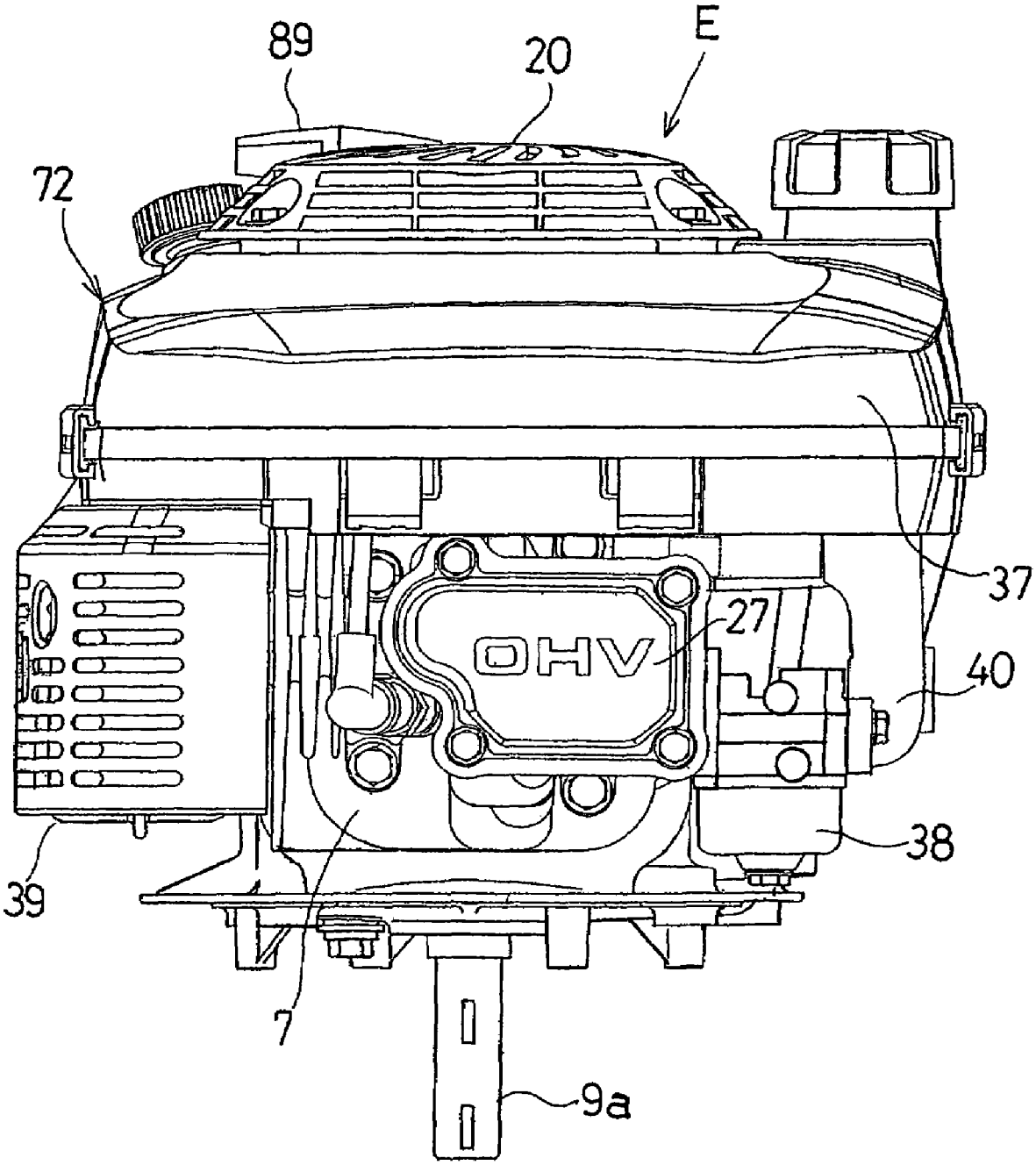
FIG. 3 is a front elevational view of the vertical shaft type internal combustion engine.
Figure 4:
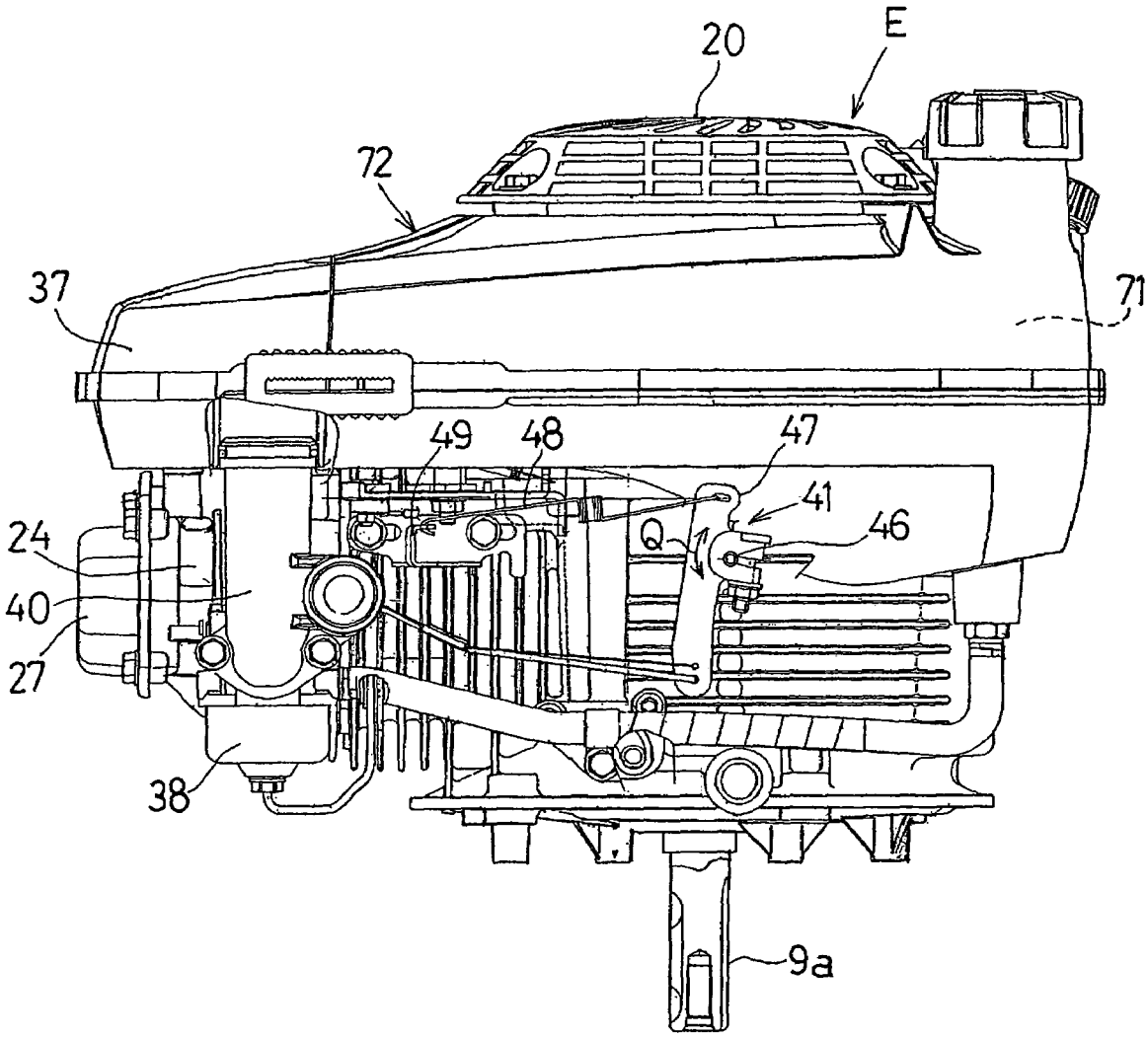
FIG. 4 is a right side view of the vertical shaft type internal combustion engine.

Referring now to FIG. 3, there is shown a front elevational view of the combustion engine E. The air cleaner 37 cooperates with a carburetor 38 to define an air-fuel intake system of the combustion engine E. The air cleaner 37 and the carburetor 38 are arranged at a front portion of the combustion engine E and at a lower right portion of the combustion engine E, respectively. A muffler 39 forming a part of an engine exhaust system is arranged at a left portion of the combustion engine E. As shown in FIG. 4 showing a right side view of the combustion engine E, an intake tube 40 extending downwardly from an air discharge outlet of the air cleaner 37 is connected with an intake port of the carburetor 38 so that an air-fuel mixture formed by the carburetor 38 can be supplied to the intake port 69 of the cylinder head 24 shown in FIG. 1.

Figure 5:
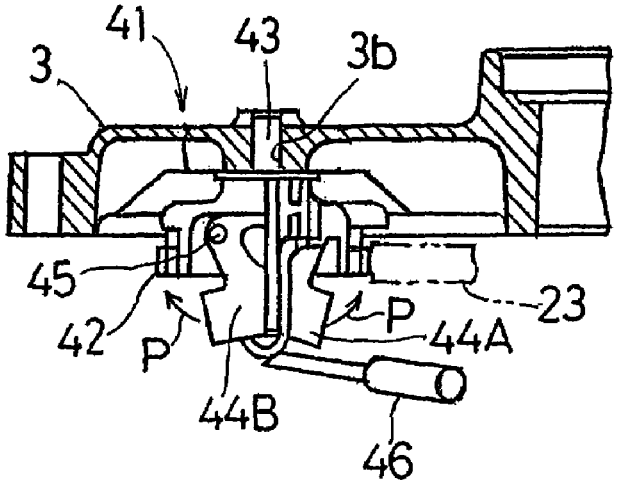
FIG. 5 is a longitudinal sectional view showing a governor mechanism employed in the vertical shaft type internal combustion engine.

FIG. 5 illustrates a longitudinal sectional view of an important portion of a governor mechanism 41 for controlling the number of revolutions of the combustion engine E. This governor mechanism 41 includes a governor gear 42 fixedly mounted on a support shaft 43, which shaft 43 is fitted in a mounting hole 3*b* defined in the crankcase cover 3. In this condition, as shown in FIG. 2, the governor gear 42 is meshed with the cam gear 23 of the camshaft 22. This governor mechanism 41 is so designed and so structured that as the governor gear 42 is rotated by the crankshaft 9 through the cam gear 23, a centrifugal force proportional to the number of revolutions of the combustion engine E acts on a pair of weights 44A and 44B rotatable together with the governor gear 42, causing the weights 44A and 44B to pivot in respective directions P away from each other around a support shaft 45 with a governor shaft 46 consequently pivoted in a direction shown by the arrow Q in FIG. 4. As shown in FIG. 4, upon pivotal movement of the governor shaft 46 in the direction Q, a governor lever 47 fixed to the governor shaft 46 is driven by the balance between the governor lever 47 and a governor spring 48 coupled with the governor lever 47, so that the number of revolutions of the combustion engine E is controlled automatically.

Figure 6:
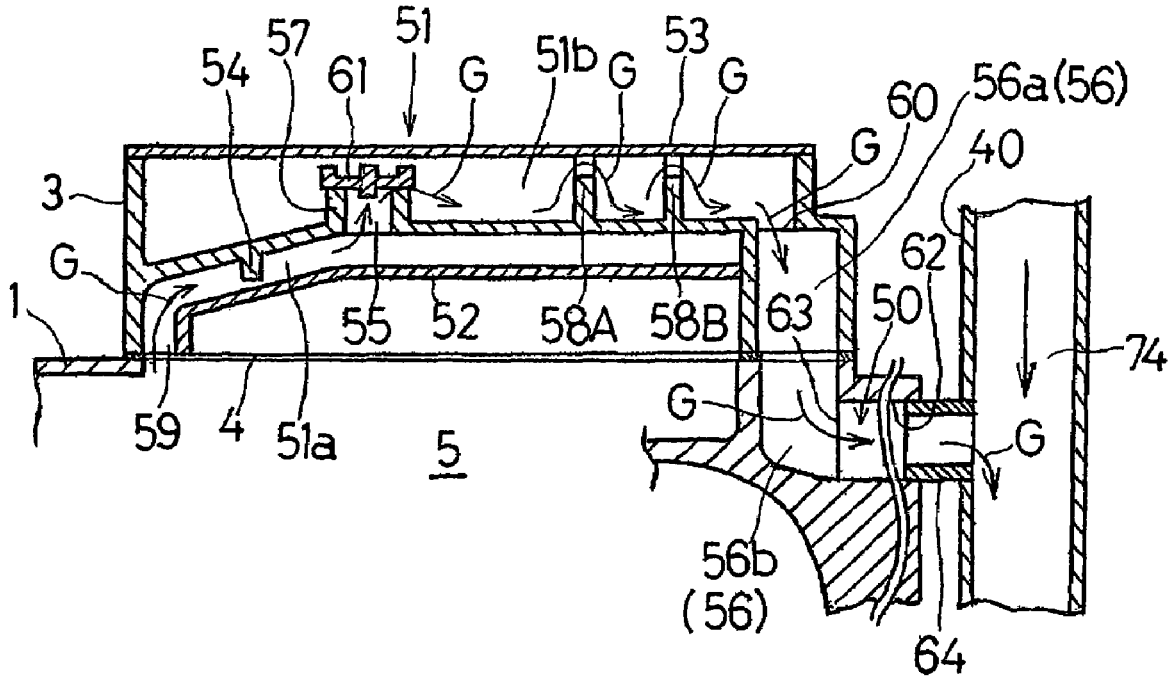
FIG. 6 is a longitudinal sectional view showing a gas-oil separating chamber employed in the vertical shaft type internal combustion engine.
Figure 7:
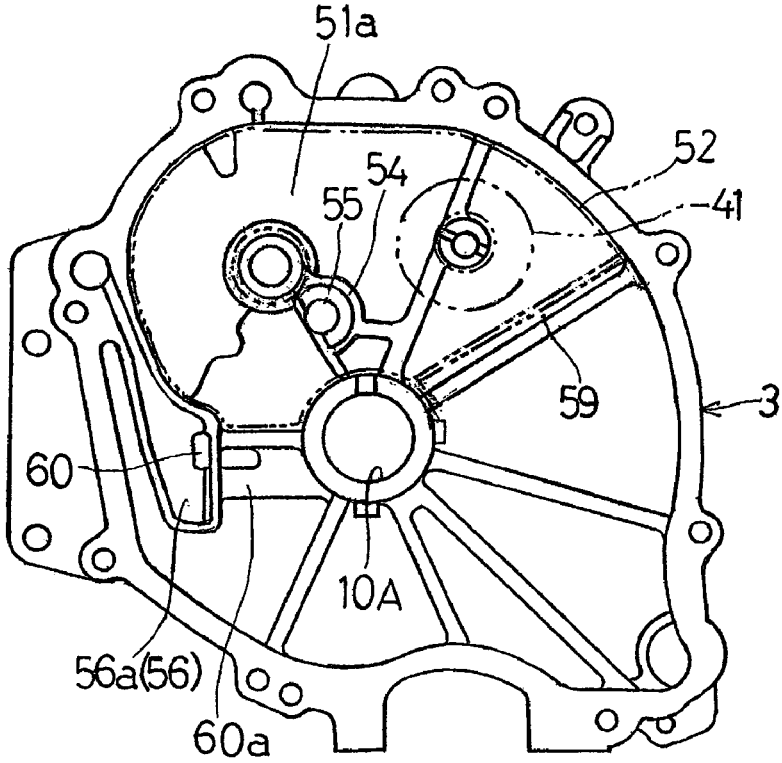
FIG. 7 is a bottom plan view of the crankcase cover.

The crankcase cover 3 is provided with a gas-oil separating chamber 51 as shown in FIG. 6. This gas-oil separating chamber 51 forms a portion of a breather passage 50 for communicating the crank chamber 5 to an intake passage 74 within the intake tube 40. This gas-oil separating chamber 51 is defined by providing inner and outer surfaces of the crankcase cover 3 with first and second cover plates 52 and 53, respectively. In other words, the inner surface (or a lower surface as viewed in FIG. 6) of the crankcase cover 3 is formed with a projecting wall 54 for defining a zigzag passage or a labyrinth, a communicating port 55 extending completely across the thickness of the crankcase cover 3 to communicate between an inner space on the inner surface side and an outer space on the outer surface side, and an upper half 56*a* of a delivery chamber 56. Also, as shown in FIG. 7, the projecting wall 54 and the communicating port 55 are covered by the first cover plate 52 to define a first chamber 51*a*, into which blow-by gases G (FIG. 6) flows from an inlet 59 defined between the first cover plate 52 and the crankcase cover 3.

On the other hand, the outer surface (or the upper surface as viewed in FIG. 6) of the crankcase cover 3 is formed with a sleeve 57 forming a part of the communicating port 55, a plurality of, for example, two partition walls 58A and 58B and a communicating hole 60 of the delivery chamber 56. A check valve 61 for selectively opening and closing an upper open end of the sleeve 57 is mounted on such upper open end of the sleeve 57. Those elements identified by 55, 57, 58A, 58B and 60 are all covered by the second cover plate 53 to define a second chamber 51*b*.

Figure 8:
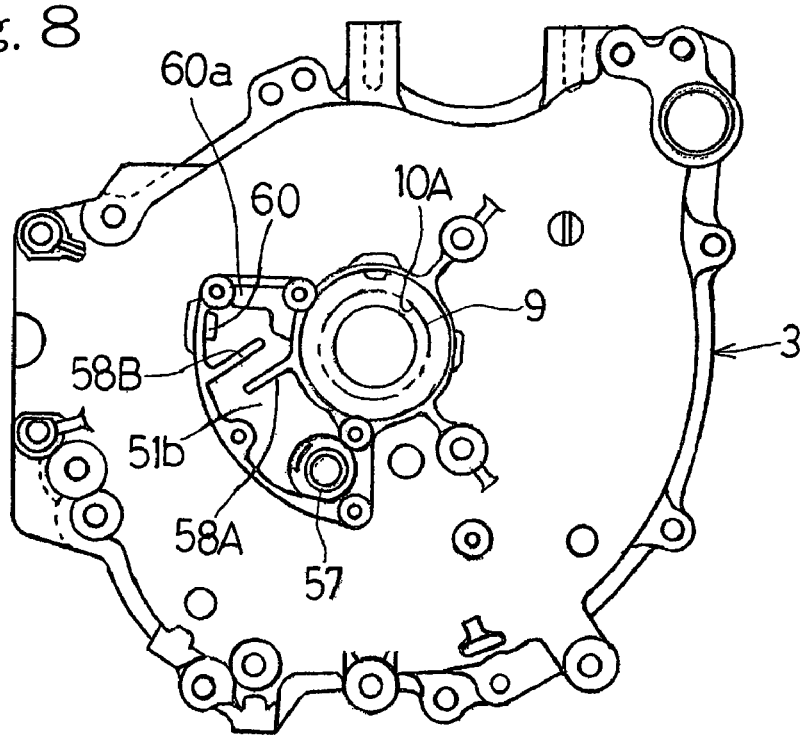
FIG. 8 is a top plan view of the crankcase cover.

The second chamber 51*b* is formed in a generally sector shape around the crankshaft upper bearing portion 10A as shown in FIG. 8, which shows the crankcase cover 3 with the second cover plate 53 removed. The crankcase 1 shown in FIG. 2 is formed with a lower half 56*b* of the delivery chamber 56 and an outlet 63 leading to a breather hole 63 defined within the cylinder block 7. The breather hole 62 is communicated with the intake passage 74 within the intake tube 40 through a breather tube 64.

The gas-oil separating chamber 51 shown in FIG. 6 serves to separate an oil component from blow-by gases. Specifically, as the blow-by gases G leaking from a combustion chamber 68 (FIG. 1) to the crank chamber 5 are introduced into the first chamber 51*a* through the inlet 59, the blow-by gases G collide against the projecting wall 54 to separate a portion of the oil component contained in the blow-by gases G and then flows into the second chamber 51*b* through the communicating port 55 by urging the check valve 61 upwardly to open the latter. The blow-by gases G flowing within the second chamber 51*b* are subsequently baffled by the partition walls 58A and 58B and, accordingly, an oil component still remaining in the blow-by gases G can be further separated therefrom.

Thereafter, the blow-by gases G, from which the oil component has been separated within the gas-oil separating chamber 51, flow into the delivery chamber 56 through the communicating hole 60 and are then guided into the intake passage 74 within the intake tube 40 through the breather hole 62 and the breather tube 64. The oil component having been so separated from the blow-by gases G is returned into the crankcase 1 through a return hole 60*a* (FIGS. 7 and 8) when a negative pressure is developed within the crankcase 1.

As shown in FIG. 1, the combustion engine E is mounted on the working machine 11 with the output shaft 9*a* of the crankshaft 9 drivingly connected with a driven unit of the working machine 11. Where the working machine 11 is a lawn mower, a cutter blade assembly 80 is connected with the output shaft 9*a*. When an operating handle 89 of the recoil starter 20 shown in FIG. 3 is manipulated, the combustion engine E starts and the cutter blade assembly 80 secured to the output shaft 9*a* is driven consequently. During the operation of the combustion engine E, the oil 67 reserved within the oil pan 2 shown in FIG. 1 is supplied by an oil pump 77, arranged at a lower end of the camshaft 22, to lubricate the crankshaft upper bearing portion 10A and others and, accordingly, an oil surface level OL2 of the oil 67 within the oil pan 2 during the operation of the combustion engine E slightly lowers than an oil surface level OL1 during the inoperative condition of the combustion engine E.

In the combustion engine E of the structure described above, the plane of joint between the upper surface 1*a* of the crankcase 1 and the lower surface 3*a* of the crankcase cover 3 is positioned above the upper crank web 14A and, also, a relatively substantial distance above the surface level OL2 of the oil 67 within the oil pan 2 during the operation of the combustion engine E.

Accordingly, the combustion engine E well prevents leakage of the oil from the plane of joint under the influence of the motion of the combustion engine E itself during the operation thereof and/or vibrations induced by the working machine 11 connected drivingly therewith.

Also, since the oil pan 2 is formed integrally with the crankcase 1, the crankcase 1 can be connected directly to the working machine 11. For this reason, the combustion engine E can provide high mounting rigidity relative to the working machine 11. In addition, the oil 67 within the oil pan 2 can be effectively cooled by the thermal conduction through the crankcase 1 then cooled by an air current from the cooling fan 18, resulting in lowering the temperature of the oil 67 and, therefore, functions of cooling and lubrication by the oil 67 of the lowered temperature can be enhanced.

Also, since the crankshaft 9 is provided with the crank gear 21 at a location above and close to the upper crank web 14A and the cam gear 23 of the camshaft 22 is meshed with this crank gear 21, both of the crank gear 21 and the cam gear 23 are held in position close to the cooling fan 18. For this reason, by the cooling effect brought about by the air current from the cooling fan 18, the cam gear 23 can be restrained from being thermally expanded during the operation of the combustion engine E. Accordingly, the gap between the cam gear 23 and the crank gear 21 can advantageously be kept stable. As a result thereof, in the combustion engine E, noises due to increase of the backlash of the cam gear 23 can advantageously be reduced.

Furthermore, since the cam gear 23 is arranged relatively spaced upwardly from the oil pan 2, the oil 67 within the oil pan 2 is not stirred up such as found with the conventional combustion engine and, accordingly, the temperature of the oil 67 can advantageously be kept low.

Since the cam gear 23 positioned above the upper crank web 14A is meshed with the governor gear 42 of the governor mechanism 41 shown in FIG. 5, a mounting hole for rotatably supporting the governor shaft 46 of the governor mechanism 41 can be formed at a location spaced upwardly from the oil pan 2 and, therefore, the leak of the oil 67 within the oil pan 2 to the outside through the mounting hole can be efficiently prevented.

In the combustion engine E, the position of the longitudinal axis of the cylinder bore 7*a* of the cylinder block 7 and the position in which the connecting rod 13 undergoes the motion are held lower by a quantity equal to the thickness of the crank gear 21 than those in the conventional combustion engine in which the crank gear 21 is positioned below the lower crank web 14B. Accordingly, when the combustion engine E is mounted on the working machine 11 positioned below the combustion engine E, vibration of the combustion engine E can advantageously be reduced to further reduce the generation of noises.

Also, since in the combustion engine E the crankcase cover 3 is formed with the gas-oil separating chamber 51 forming a portion of the breather passage 50 for communicating the crank chamber 5 with the intake passage 74 as shown in FIG. 6, the space for installing the gas-oil separating chamber 51 is not limited. As a result, the gas-oil separating chamber 51 can easily have a desired structure having a sufficient capacity. This is indeed in contrast to the conventional combustion engine, in which the gas-oil separating chamber is defined inside the crankcase. In view of this, the gas-oil separating chamber 51 is designed to represent the structure in which the first and second chambers 51*a* and 51*b* are formed on the respective sides of the lower and upper surfaces of the crankcase cover 3. This design allows the gas-oil separating chamber 51 to enhance the separation of the blow-by gases G within the breather passage 50 into the oil component and the gases.

Also, since the gas-oil separating chamber 51 is intended to be formed in the crankcase cover 3, it becomes possible to arrange at a location intermediate of the combustion engine E in its entirety and, therefore, the oil 67 separated from the blow-by gases G within the gas-oil separating chamber 51 will hardly leak into the intake passage 74 when the combustion engine E is tilted.

Yet, as shown in FIG. 1, the combustion engine E has the structure in which the crankcase cover 3 is mounted on the upper surface of the crankcase 1 and the crank gear 21 is positioned above the upper crank web 14A. Accordingly, assemblage of the combustion engine E can easily be accomplished by inserting the camshaft 22 into the crankcase 1 through the top opening of the crankcase 1 in a vertically downward direction until the cam gear 23 of the camshaft 2 comes to be meshed with the crank gear 21 of the crankshaft 9. On the other hand, the servicing of the combustion engine E can be accomplished by removing the crankcase cover 3 from the crankcase 1 to allow the interior of the crankcase 1 to be inspected from above and, therefore, the combustion engine E need not be separated from the working machine, thereby facilitating the servicing.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A combustion engine of a vertical shaft type, which engine comprises:

a vertically extending crankshaft having a pair of upper and lower crank webs;

a crankcase accommodating the crankshaft and including an oil pan, the crankcase having an upper surface positioned above the upper crank web;

a crankcase cover mounted on the upper surface of the crankcase for covering the crankcase; and a breather passage for communicating a crank chamber in the crankcase with an intake passage;

wherein the crankcase cover has a lower surface and an upper surface formed respectively with a first chamber and a second chamber that communicate with each other to form a gas-oil separating chamber, within the lower and upper surfaces, the gas-oil separating chamber then forming a part of the breather passage.

2. The combustion engine as claimed in claim 1, further comprising a camshaft extending parallel to the crankshaft and having a cam gear, and a crank gear mounted on the crankshaft at a location above the upper crank web, the cam gear on the camshaft being meshed with the crank gear on the crankshaft.

3. The combustion engine as claimed in claim 1, wherein the crankshaft has an upper end and further comprising a cooling fan mounted on the upper end of the crankshaft.

4. A combustion engine of a vertical shaft type, which comprises:

a vertically extending crankshaft having a pair of upper and lower crank webs;

a camshaft extending parallel to the crankshaft and having a cam gear;

a crank gear mounted on the crankshaft at a location above the upper crank web, the cam gear on the camshaft being meshed with the crank gear on the crankshaft;

a governor mechanism controlling the number of revolutions of the combustion engine and including a governor gear meshed with the cam gear for driving the governor mechanism;

a crankcase accommodating the crankshaft and including an oil pan, the crankcase having an upper surface positioned above the upper crank web; and a crankcase cover mounted on the upper surface of the crankcase for covering the crankcase.

5. The combustion engine as claimed in claim 4, further comprising a support shaft for supporting the governor gear and wherein the crankcase cover has a mounting hole defined therein for receiving the support shaft.

6. The combustion engine as claimed in claim 4, further comprising a breather passage for communicating a crank chamber in the crankcase with an intake passage and wherein the crankcase cover is formed with a gas-oil separating chamber that forms a part of the breather passage.

7. The combustion engine as claimed in claim 6, wherein the crankshaft has an upper end and further comprising a cooling fan mounted on the upper end of the crankshaft.

8. In a combustion engine having a crankcase and a breather passage communicating with a crank chamber in the crankcase, to receive blow-by gases, the improvement comprising:

a crankcase cover unit removably mounted on a surface of the crankcase to provide access to an interior of a crankcase chamber, the crankcase cover unit including a crankcase cover and a first chamber and a second chamber that are positioned within the crankcase cover and removably mounted on the crankcase with the crankcase cover, wherein the crankcase cover is formed with two partition walls extending upward into the second chamber and at least one projecting wall extending downward into the first chamber adjacent an entrance of the blow-by gases, the first chamber communicating with the crank chamber and with the second chamber to receive blow-by gases and to collectively separate gases from oil as a portion of the breather passage; and a check valve controlling the communication between the first chamber and the second chamber wherein the first chamber is positioned below the second chamber within the crankcase cover unit.

* * * * *